US007533599B2

(12) United States Patent
Mogensen

(10) Patent No.: US 7,533,599 B2
(45) Date of Patent: May 19, 2009

(54) COVERING FOR BULLETPROOFING A WALL

(75) Inventor: Nis Mogensen, Køge (DK)

(73) Assignee: Nimas Holding ApS, Køge (DE)

( * ) Notice: Subject to any disclaimer, the term of this patent is extended or adjusted under 35 U.S.C. 154(b) by 0 days.

(21) Appl. No.: 11/582,922

(22) Filed: Oct. 17, 2006

(65) Prior Publication Data

US 2007/0113731 A1 May 24, 2007

Related U.S. Application Data

(63) Continuation of application No. PCT/IB2005/051285, filed on Apr. 20, 2005.

(30) Foreign Application Priority Data

Apr. 23, 2004 (DK) ..... 2004 00646

(51) Int. Cl.
*F41H 5/013* (2006.01)
*F41H 5/24* (2006.01)

(52) U.S. Cl. ..... 89/36.04

(58) Field of Classification Search ..... 2/2.5; 89/36.04, 36.08, 36.11, 36.15, 36.05; 52/538
See application file for complete search history.

(56) References Cited

U.S. PATENT DOCUMENTS

| | | | | | |
|---|---|---|---|---|---|
| 2,020,702 | A | * | 11/1935 | Russell | 2/2.5 |
| 4,391,178 | A | | 7/1983 | Pagno | 89/36 H |
| 4,633,756 | A | * | 1/1987 | Rudoi | 89/36.02 |
| 5,060,314 | A | * | 10/1991 | Lewis | 2/2.5 |
| 5,125,196 | A | * | 6/1992 | Moody | 52/173.2 |
| 5,247,770 | A | * | 9/1993 | Ting | 52/309.9 |
| 5,377,577 | A | | 1/1995 | Bounkong et al. | 89/36.05 |
| 6,543,055 | B2 | * | 4/2003 | Howland et al. | 2/2.5 |

FOREIGN PATENT DOCUMENTS

| | | |
|---|---|---|
| DE | 1 127 759 | 12/1959 |
| DE | 2 344 222 | 6/1974 |
| DE | 3931895 | 12/1994 |
| WO | WO 92/08094 | 5/1992 |

* cited by examiner

*Primary Examiner*—Stephen M Johnson
(74) *Attorney, Agent, or Firm*—Winston & Strawn LLP

(57) ABSTRACT

A covering of the kind serving for bulletproof armoring of a wall and including a number of bulletproof plates. The covering furthermore includes a support having a base for mounting on the wall, and a number of pockets arranged to keep the plate in positions, in which they overlap or adjoin each other in twos. This advantageously results in the fact that the walls of a container can be covered with bulletproof plates easily and quickly without leaving a space through which shots can be fired.

15 Claims, 5 Drawing Sheets

COVERING FOR BULLETPROOFING A WALL

CROSS-REFERENCE TO RELATED APPLICATIONS

This application is a continuation of International application PCT/IB2005/051285 filed Apr. 20, 2005, the entire content of which is expressly incorporated herein by reference thereto.

BACKGROUND ART

The invention relates to a covering of the kind serving for bulletproof armoring of a wall and comprising a number of bulletproof plates, a support having a base for mounting on the wall and a number of pockets arranged to keep the plates in positions in which they overlap or adjoin each other in twos.

Personnel from e.g. military units or humanitarian organizations in crisis areas often have to live and/or work in e.g. personnel containers which can be transported to and put up in the area in question easily and quickly.

However there are numerous examples of hostile persons shooting at the personnel in the containers via its walls, which normally are not strong enough in themselves to stop a projectile.

U.S. Pat. No. 4,391,178 discloses a container of a military logistic vehicle. The sidewalls of the container are covered with a bulletproof armoring comprising a number of bulletproof plates placed in pockets in a fabric covering. The fabric covering is divided into two single parts anchored each to a center ridge pole on the roof of the container. The two parts of the fabric covering are rolled up on the roof at the center ridge pole when being not used. The known bullet proof armoring suffers of the problem that it can be used only to one specific container since each part of the fabric covering consists of one single piece having a predetermined length and width. Another problem consists in that the roof of the container is not protected. Persons in the container therefore are not protected against projectiles fired from a higher level than the container or against hand bombs or fire from bazookas. Thus, there is a need for improved devices of this type.

SUMMARY OF THE INVENTION

A first aspect according to the invention is to provide a covering of the kind serving for bulletproof armoring of a wall and comprising a number of bulletproof plates, a support having a base for mounting on the wall and a number of pockets arranged to keep the plates in positions in which they overlap or adjoin each other in twos, wherein the covering is strong enough to stop a projectile.

A second aspect according to the invention is to provide this covering in a form and configuration that takes up as little room as possible in storage.

A third aspect according to the invention is to provide this covering in a form and configuration that can easily be transported to a crisis area together with the personnel containers.

A fourth aspect according to the invention is to provide this covering in a form and configuration that can be mounted on such personnel containers easily and quickly.

A fifth aspect according to the invention is to provide this covering in a form and configuration that cannot or only can be destroyed or removed from a personnel container with difficulty by unauthorized persons.

According to the invention, these aspects and advantages are obtained in a covering for bulletproof armoring of a wall, comprising a number of bulletproof plates, a support having a base for mounting on the wall, a number of pockets arranged for keeping the plates in positions in which they overlap or adjoin each other in twos, wherein the base of the support is divided into sections having free edges and at least one row of the pockets, and at least two cooperating flaps having free edges and being associated with the free edges of adjacent sections, with the flaps having connection means along their free edges for connection to adjacent flaps. Preferably, the cooperating flaps are fastened onto those of adjacent sections at a spaced distance from each of their opposite free edges by the connection means, such as e.g., zippers or straps or Velcro™ or hooks or buttons.

BRIEF DESCRIPTION OF THE DRAWINGS

The invention will be explained in greater details below, describing only exemplary embodiments with reference to the drawing, in which.

DETAILED DESCRIPTION OF PREFERRED EMBODIMENTS

The present construction has the advantage that the sections can easily and safely be connected to coherent covering fitting to containers of different sizes. The covering will furthermore be easy to store, transport to the place of use, and mount on e.g. a container, which is to be made bulletproof.

If there are several flaps cooperating in pairs and having connection means, and the two flaps of each pair are fastened at a different distance from each of their opposite edges on the two base sections than the flaps of the other pairs, it is advantageously obtained that the same support can be used for bulletproof plates of different widths or optionally mounting rectangular plates either horizontally or vertically.

To eliminate the risk of the bulletproof plates being removed by unauthorized persons, the flaps and pockets can be located on opposite sides of the base and the pockets can face in towards the wall in the mounted state of the covering.

If the pockets furthermore are adapted to the size of the plates, and the pockets in each row in the sections are provided with an opening for insertion of one or more bulletproof plates, and each of these openings are located at a shorter distance from the opening of an adjacent pocket than the distance between the opening and bottom of a pocket, it is advantageously obtained that the bulletproof plates in a row are certain to overlap each other and simultaneously be secured effectively in their respective pockets.

According to the invention can the covering advantageously offer persons in a personnel container protection against fire like projectiles irrespective of the angle from which the fire is coming.

Unauthorized persons cannot or at least only with difficulty destroy the covering if at least the base of the support is made of a strong material, such as e.g. steel or textile. The sections of the support can be assembled by means of the connection means to a complete unit encompassing the container and thereby retained on this one. For further protection for example wires or cables can be used to lock the support to the container.

Figure 1:
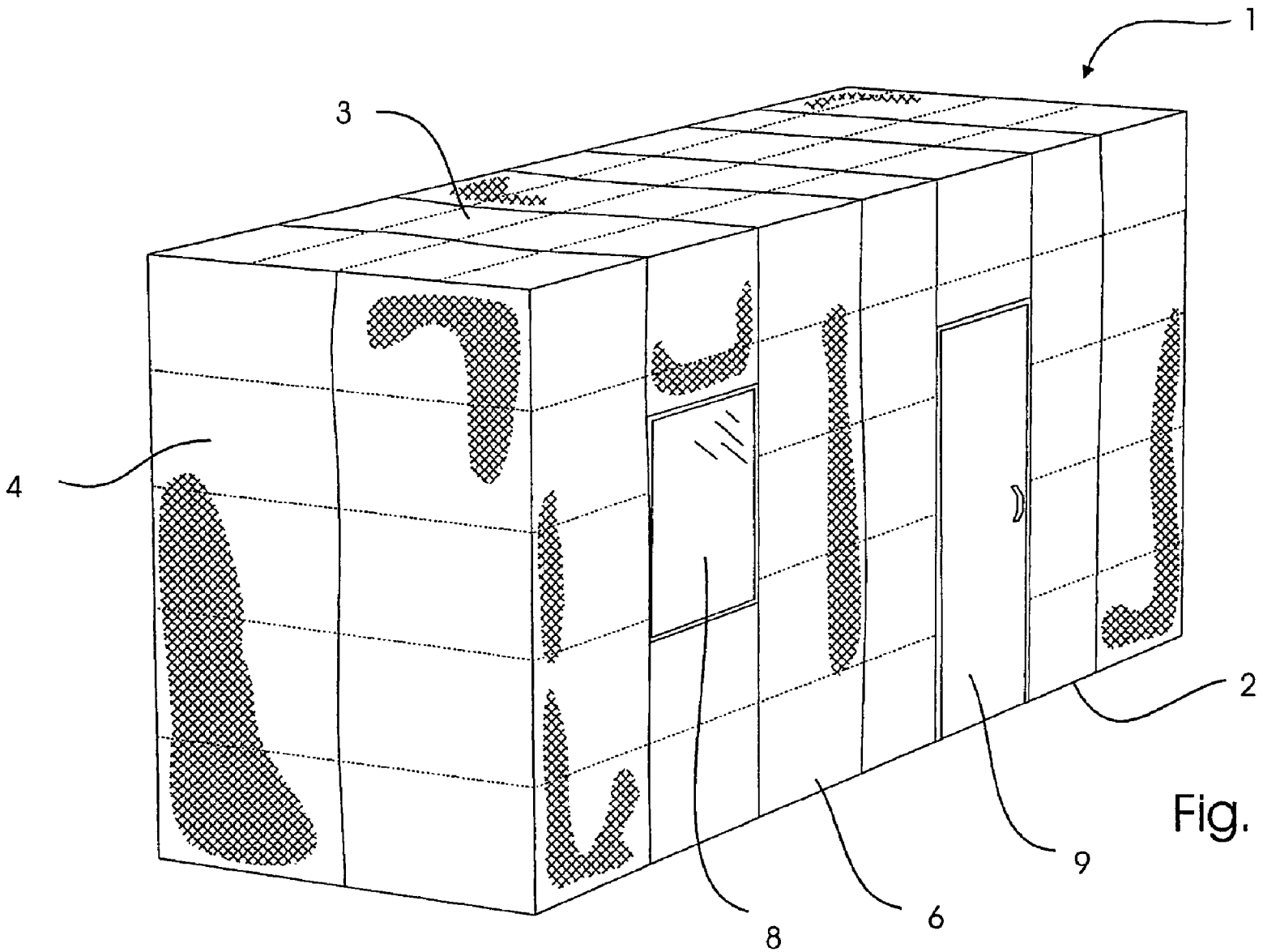
FIG. 1 shows a container covered by a covering according to the invention.
Figure 2:
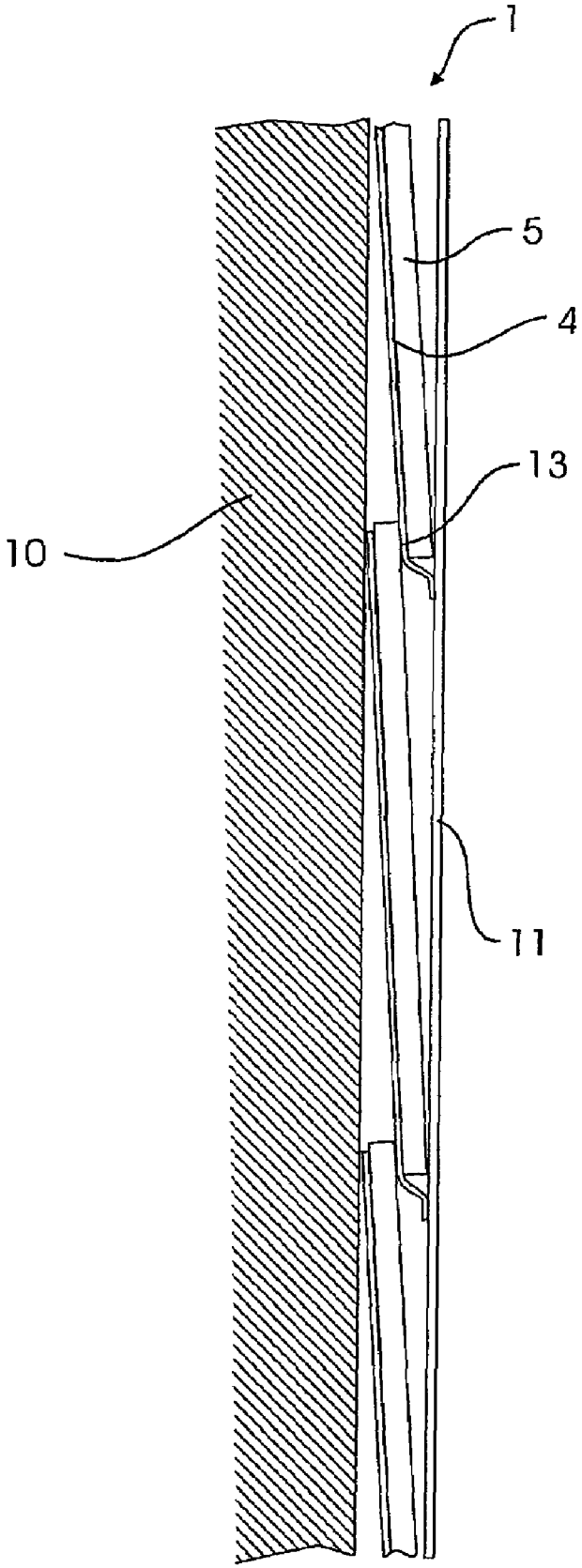
FIG. 2 is a side elevational, sectional, fractional view of a wall in the container in FIG. 1 with a covering according to the invention.

FIG. 1 shows a covering 1 according to the invention serving for bulletproof armoring of a container or enclosure 2. The covering comprises a support 3 with a number of pockets 4, with a bulletproof plate 5 located in each pocket. This is shown in more detail in As shown in FIG. 2. The enclosure also may have doors 8 and/or windows 9.

Figure 3:
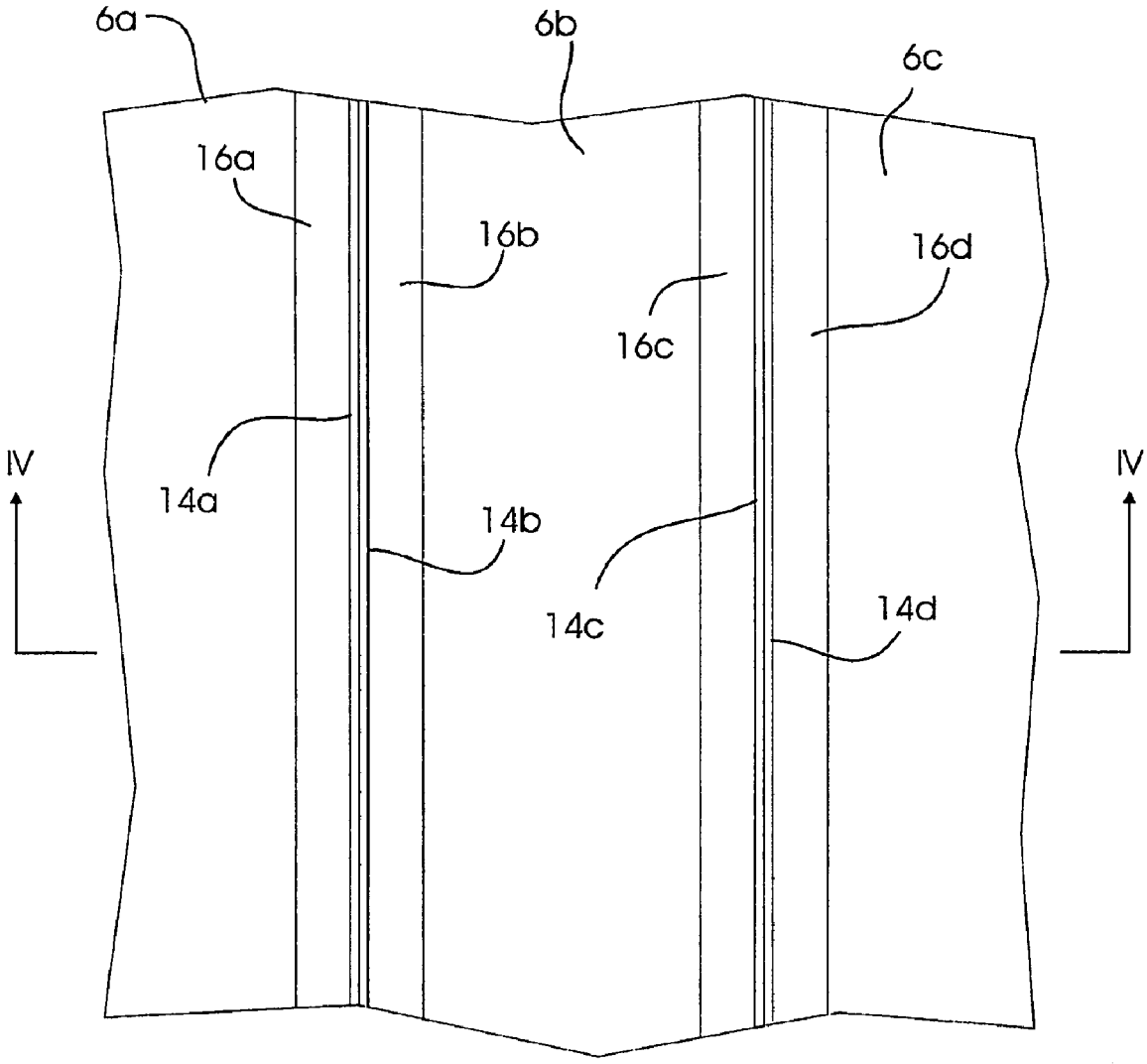
FIG. 3 is a rear view of the covering in FIG. 2.

The covering is divided into a number of sections 6 indicated in solid line in FIG. 1. Each section is provided with a vertical arrangement of pockets 4 indicated in broken line shown in FIG. 6. As shown in FIG. 3, the sections are interconnected by means of e.g. a zipper. As noted above, this connection means can instead be a Velcro™ fastener, which is well known and is generally referred to as a hook and loop fastener. Alternatively, these fasteners can be straps or hooks or buttons, as desired to facilitate the particular configuration. Dividing the covering into sections makes it possible to, if so desired, keep possible doors 8 and windows 9 in the container free of covering easily and quickly, as the part of the section in question quite simply is cut off or folded in under the section.

FIGS. 2 and 3 are fractional sectional views of a vertically mounted wall, on which the bulletproof covering is mounted, said covering consisting more specifically of a base 11, a number of pockets 4, and a number of bulletproof plates 5 located in the pockets 4. The pockets are constructed in such a way that they overlap each other in an area 13. Thereby, it is advantageously obtained that there is no free space between the bulletproof plates through which shots can be fired.

Figure 4:
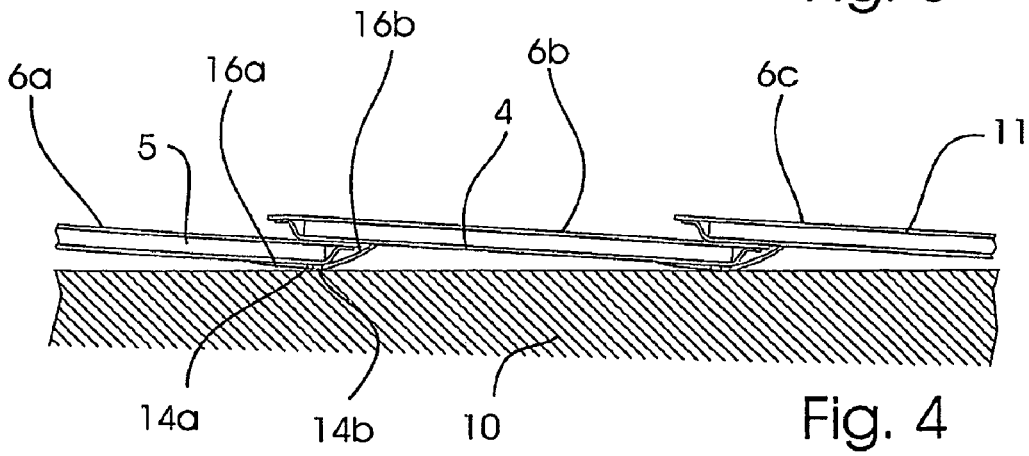
FIG. 4 is a sectional view taken along the line of IV-IV of FIG. 3.

FIGS. 3 and 4 are fractional views of the support seen from within and above, respectively, with in this case three sections 6*a*,6*b*,6*c* provided with zippers 14*a*, 14*b*, 14*c* for connecting the sections to each other.

Figure 8:
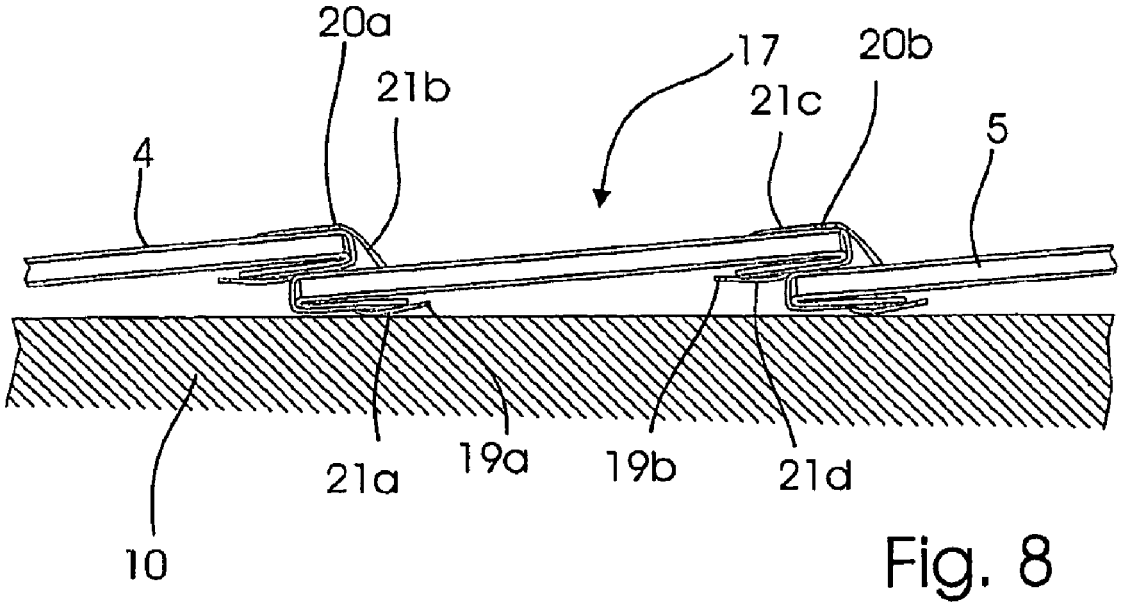
FIG. 8 is on a larger scale a fractional sectional view of a number of the sections in FIG. 7 in assembled state.

As seen in e.g. FIGS. 3, 4, and 8, each zipper is connected to the associated section at a distance from the edge of this section via a flap 16*a,b,c,d* of a length that allows the section to be connected to an adjacent section in such a way that the bulletproof plates will overlap each other.

This flap can be made of the same material as the rest of the support or can be elastic. In the last-mentioned case, the advantage is obtained in that the sections and thereby the bulletproof plates are kept tightly towards each other in the overlapping area.

Figure 5:
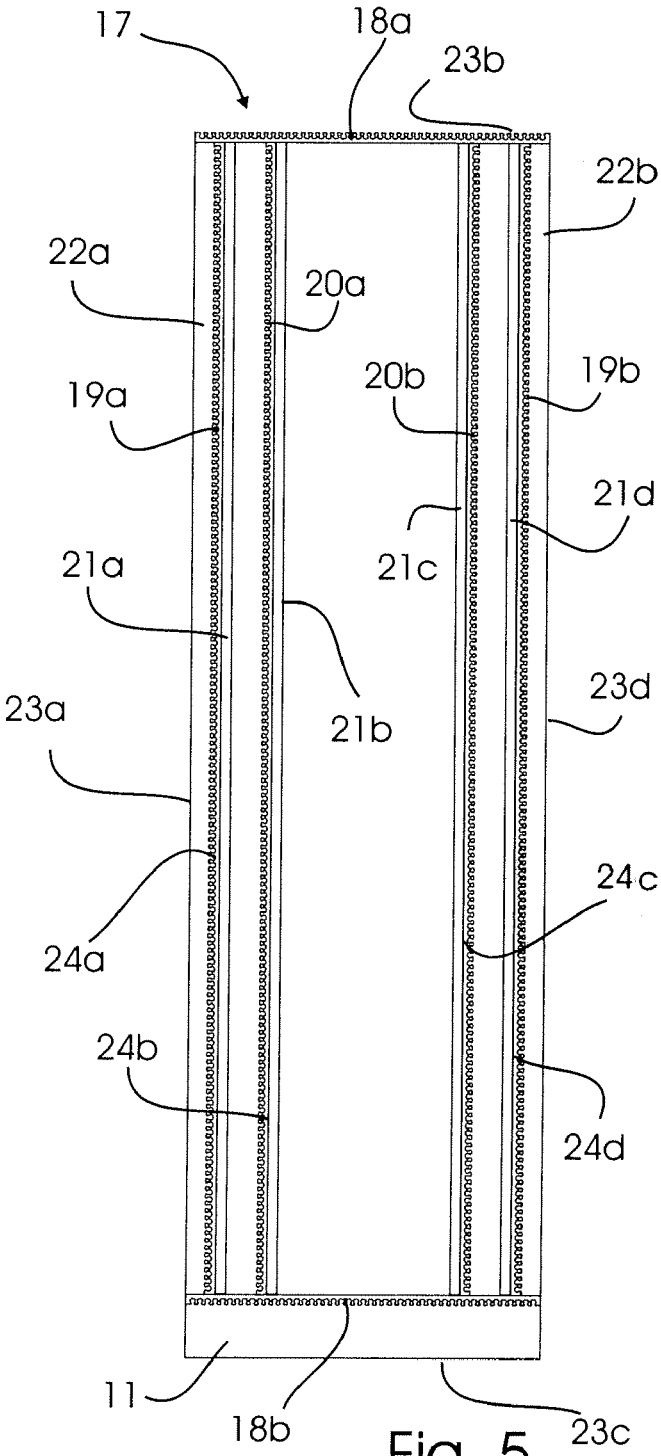
FIG. 5 is a view from within of a section of the covering according to the invention.
Figure 6:
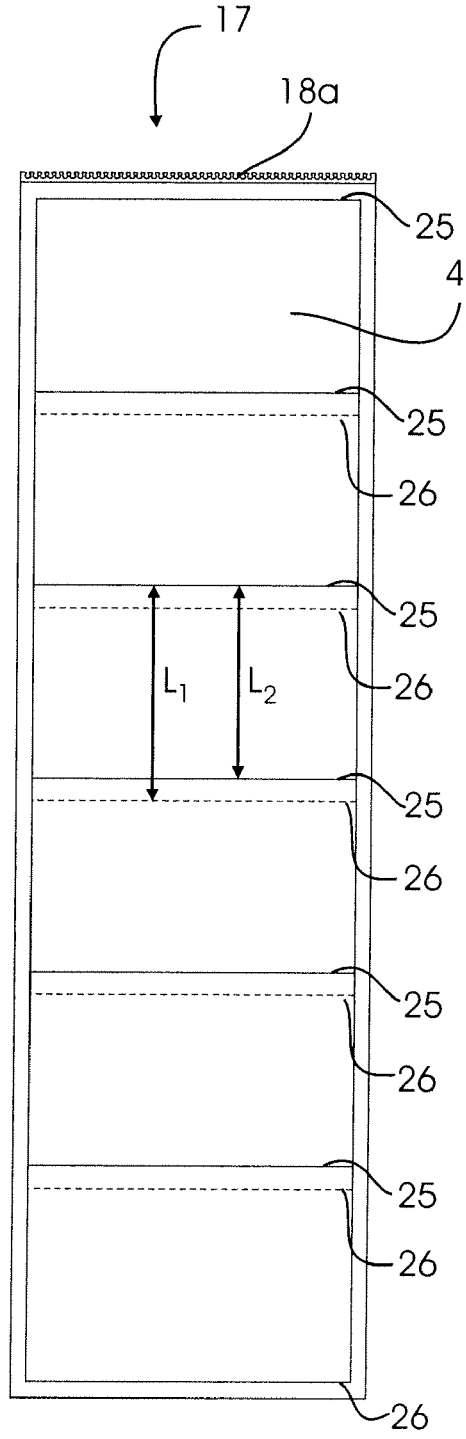
FIG. 6 is a view from outside of the section in FIG. 5.

FIGS. 5 and 6 show, seen from within and from outside, respectively, a section 17 consisting of a base 11 having on one side two horizontal zippers 18*a,b* and four vertical zippers 19*a,b* and 20*a,b*, and on the other side six pockets overlapping each other as described with reference to FIG. 2. Each of the horizontal zippers are, as described earlier, fastened to the section via flaps 21*a,b,c,d*. The free edges of the section are shown as 23*a-d*, the free edges of the flaps are indicated as 24*a-d*, the opening of the pocket is 25, the bottom of the pocket is 26, the distance between the opening 25 and the bottom 26 of a pocket is $L_1$ and $L_2$ is the distance between the openings 25.

The bulletproof plates 5 can for example be rectangular. The zippers 19*a* and 19*d* serve, as shown in FIGS. 3 and 4, to connect adjacent sections when the bulletproof plates are placed in the pockets with their long side oriented horizontally. Thus, each plate at its perimeter will overlap an adjacent plate.

Figure 7:
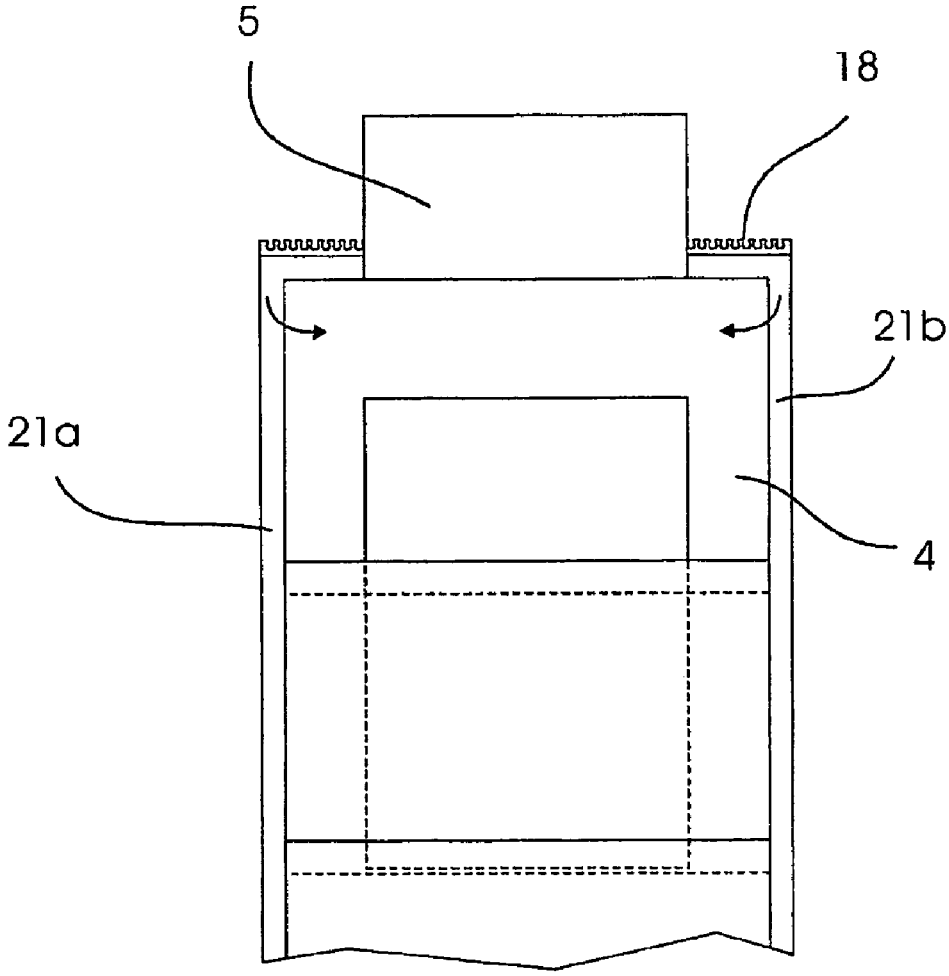
FIG. 7 is a fractional view of a vertically mounted section with a bulletproof plate located in a pocket.

The zippers 20*a* and 20*b* serve, as shown in FIGS. 7 and 8, to connect adjacent sections when the bulletproof plates are placed in the pockets with their short side oriented horizontally. The free sides 22*a* and 22*b* of the sections are folded, in this case as shown in FIG. 8, onto the opposite side of the side on which the zippers are fastened.

What is claimed is:

1. A covering configured and dimensioned for bulletproof armoring of a wall, comprising:

a number of bulletproof plates, a support having a base for mounting on the wall of an enclosure, a number of exposed pockets arranged for keeping the number of bulletproof plates in positions in which neighboring bulletproof plates overlap or adjoin each other two by two;

wherein the base of the support is divided into sections having free edges and at least one vertical arrangement of said pockets, and at least two cooperating flaps having free edges for being associated with the free edges of flaps on adjacent sections, with the flaps having connection means along their free edges for connection to adjacent flaps.

2. The covering according to claim 1, wherein the cooperating flaps are fastened onto those of adjacent sections at a spaced distance from each of their opposite free edges.

3. The covering according to claim 1, which comprises at least four cooperating flaps fastened in pairs on each of two adjacent sections, with the two flaps of one pair fastened at a different distance from the opposite edges on the two base sections than the flaps in another pair, with the free edges of each pair provided with connection means.

4. The covering according to claim 3, wherein the flaps and pockets are located on opposite sides of the base, and the pockets face towards the wall in the mounted state of the support on the wall.

5. The covering according to claim 1, wherein the pockets in each vertical arrangement are provided with an opening for insertion of one or more bullet proof plates, and each opening is located at a shorter distance from the opening of an adjacent pocket than the distance between the opening and bottom of the pocket.

6. The covering according to claim 5, wherein the enclosure has a roof and sidewalls with the support on the sidewalls and the support on the roof connected by the connection means.

7. The covering according to claim 1, wherein the connection means comprises one or more of zippers, straps or hook and loop fasteners, or hooks or buttons.

8. The covering according to claim 1, wherein at least the base of the support is made of steel.

9. The covering according to claim 1, wherein at least the base of the support is made of a flexible material.

10. The covering according to claim 1, wherein at least the base of the support is made of a textile.

11. The covering according to claim 1 in combination with the enclosure, wherein the covering protects persons in the enclosure against projectiles fired from hostile persons against the enclosure, wherein the wall includes a roof on the enclosure.

12. The covering according to claim 11, wherein the connection means comprises one or more of zippers, straps or hook and loop fasteners, or hooks or buttons.

13. The covering of claim 12, wherein the enclosure has one or more doors or windows and the covering does not cover the door(s) and window(s).

14. The covering of claim 1 wherein the bullet proof plates are rectangular in size, and the pockets are configured and arranged so that the each plate at its perimeter overlaps an adjacent plate.

15. The covering of claim 1, wherein the sections can easily and safely be configured for fining onto containers of different sizes.

* * * * *